United States Patent [19]

Dickakian

[11] 4,431,512

[45] * Feb. 14, 1984

[54] AROMATIC PITCH FROM ASPHALTENE-FREE STEAM CRACKER TAR FRACTIONS

[75] Inventor: Ghazi Dickakian, Greenville, S.C.

[73] Assignee: Exxon Research and Engineering Co., Florham Park, N.J.

[ * ] Notice: The portion of the term of this patent subsequent to Jun. 2, 1998 has been disclaimed.

[21] Appl. No.: 346,623

[22] Filed: Feb. 8, 1982

[51] Int. Cl.[3] ..... C10C 1/00; C10C 3/00; C10C 1/20

[52] U.S. Cl. ..... 208/44; 208/22; 208/40; 423/447.4; 423/447.6; 423/448; 423/449

[58] Field of Search ..... 208/22, 44, 40; 423/447.4, 447.6, 448, 449

[56] References Cited

U.S. PATENT DOCUMENTS

| | | | |
|---|---|---|---|
| 3,721,658 | 3/1973 | Dickakian | 526/221 |
| 4,086,156 | 4/1978 | Dickakian | 208/41 |
| 4,271,006 | 6/1981 | Dickakian | 208/45 |

*Primary Examiner*—Delbert E. Gantz
*Assistant Examiner*—Helane E. Maull

[57] ABSTRACT

A process and a product of the process for preparing a pitch suitable for carbon artifact manufacture features a pitch having a weight content of between 80 and 100 percent toluene insolubles. The pitch is derived from a deasphaltenated middle fraction of a steam cracker tar feedstock. The middle fraction is rich in 2, 3, 4, and 5 polycondensed aromatic rings. The pitch is characterized as being relatively free of impurities and ash.

20 Claims, 1 Drawing Figure

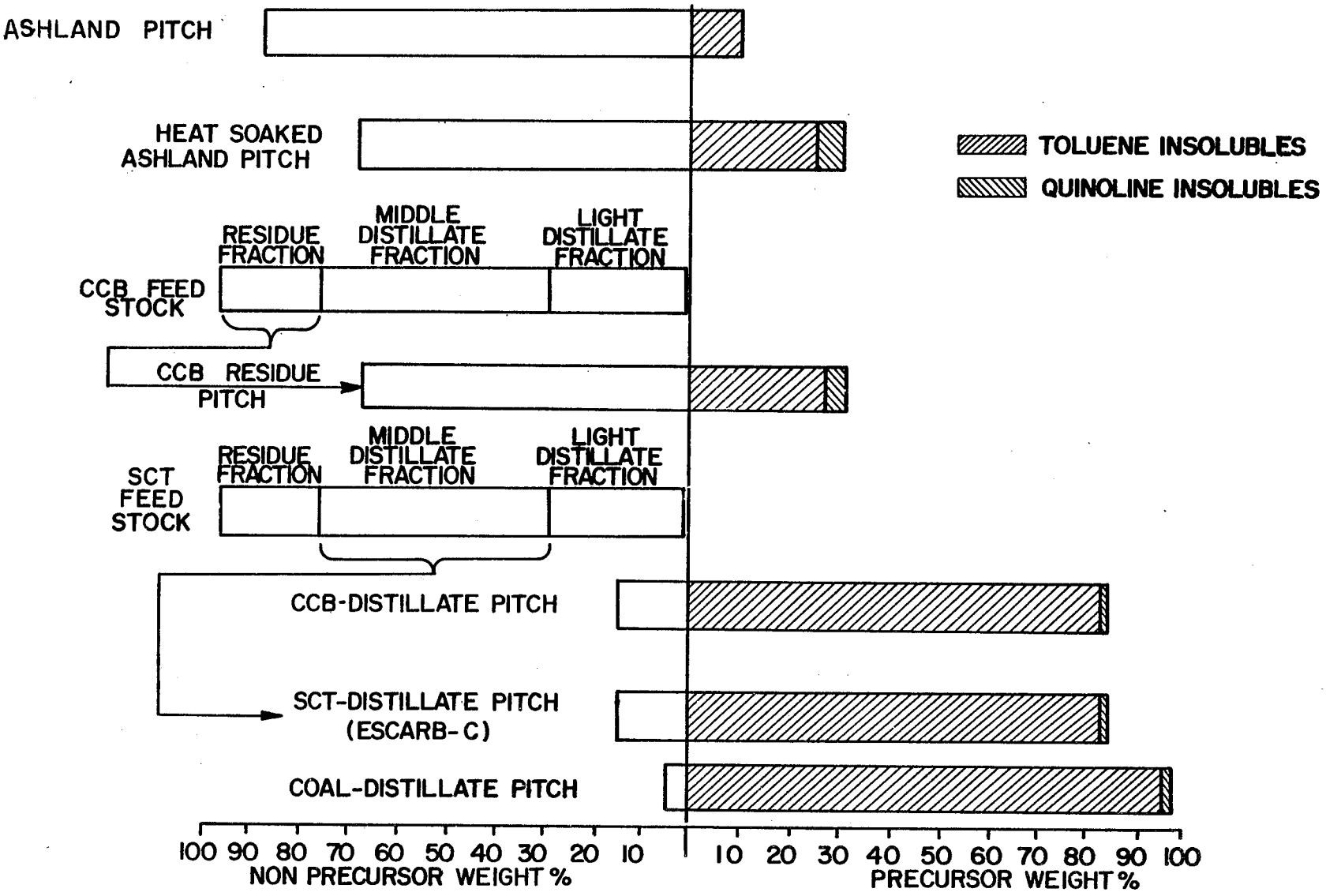
TOLUENE INSOLUBLES
QUINOLINE INSOLUBLES
ASHLAND PITCH
HEAT SOAKED ASHLAND PITCH
CCB FEED STOCK
RESIDUE FRACTION
MIDDLE DISTILLATE FRACTION
LIGHT DISTILLATE FRACTION
CCB RESIDUE PITCH
SCT FEED STOCK
RESIDUE FRACTION
MIDDLE DISTILLATE FRACTION
LIGHT DISTILLATE FRACTION
CCB-DISTILLATE PITCH
SCT-DISTILLATE PITCH (ESCARB-C)
COAL-DISTILLATE PITCH
100 90 80 70 60 50 40 30 20 10
NON PRECURSOR WEIGHT %
10 20 30 40 50 60 70 80 90 100
PRECURSOR WEIGHT %

AROMATIC PITCH FROM ASPHALTENE-FREE STEAM CRACKER TAR FRACTIONS

FIELD OF THE INVENTION

The present invention relates to the process for preparing a pitch used in carbon artifact manufacture such as carbon fiber production. More particularly, the present invention relates to a process for preparing a pitch with high liquid crystal fraction from a steam cracker tar distillate or a deasphaltenated steam cracker tar.

BACKGROUND OF THE INVENTION

As is well-known, carbon artifacts have been made by pyrolyzing a wide variety of organic materials. Indeed, one carbon artifact of particularly important commercial interest today is carbon fiber. Hence, specific reference is made herein to carbon fiber technology. Nevertheless, it should be appreciated that this invention has applicability to carbon artifact manufacturing generally, and most particularly, to the production of shaped carbon articles in the form of filaments, yarns, films, ribbons, sheets and the like.

The use of carbon fibers for reinforcing plastic and metal matrices has gained considerable commercial acceptance. The exceptional properties of these reinforcing composite materials, such as their high strength to weight ratio, clearly offset their high preparation costs. It is generally accepted that large scale use of carbon fibers as a reinforcing material would gain even greater acceptance in the marketplace, if the costs of the fibers could be substantially reduced. Thus, formation of carbon fibers for relatively inexpensive carbonaceous pitches has received considerable attention in recent years.

Many materials containing polycondensed aromatics can be converted at early stages of carbonization to a structurally ordered optically anisotropic spherical liquid crystal called mesophase. The presence of this ordered structure prior to carbonization is considered to be fundamental in obtaining a high quality carbon artifact. Thus, one of the first requirements of a feedstock material suitable for carbon artifact manufacture, and particularly for carbon fiber production, is its ability to be converted to a highly optically anisotropic material.

In addition, suitable feedstocks for carbon artifacts manufacture, and in particular carbon fiber manufacture, should have relatively low softening points and sufficient viscosity suitable for shaping and spinning into desirable articles and fibers.

Unfortunately, many carbonaceous pitches have relatively high softening points. Indeed, incipient coking frequently occurs in such materials at temperatures where they have sufficient viscosity for spinning. The presence of coke, infusible materials, and/or high softening point components are detrimental to the fiber making process.

As is well-known, pitches have been prepared from the total tars obtained from steam cracking of gas oil or naphtha. In this regard, see, for example, U.S. Pat. Nos. 3,721,658 and 4,086,156.

Steam cracker tar, like other heavy aromatics, is composed of a complex mixture of alkyl-substituted polycondensed aromatics. The chemical structure, molecular weight and aromatic ring distribution can be determined quantitatively using advanced analytical methods such as carbon and proton nuclear resonance spectroscopy or mass spectrometry.

Steam cracker tar, like other heavy aromatics such as coal tars and tars from catalytic or fluid cracking, is composed of two major parts: (1) a low molecular oil; and (2) a high molecular weight fraction called asphaltene, which is insoluble in a paraffinic solvent. The asphaltene in steam cracker tar varies from 10–30 wt % depending on the type of feedstock being introduced into the cracker, the design of the cracker and the severity of the cracking.

Asphaltenes can be determined quantitatively in steam cracker tar using n-heptane.

The two aforementioned parts of steam cracker tar, i.e., the oil and the asphaltene, vary significantly in their chemical composition, molecular weight, melting characteristics and most importantly their coking characteristics.

The asphaltene presence in the steam cracker tar tends to be detrimental to carbon artifact manufacture, because it produces coke in the pitch and more importantly it does not provide a pitch with a high liquid crystal content; i.e., it severely limits the composition of the pitch.

SUMMARY OF THE INVENTION

This invention features an optically anisotropic pitch which is prepared from an asphaltene-free steam cracker tar middle distillate fraction by heat soaking the middle distillate fraction at 420°–440° C. between 2–6 hours at atmospheric pressure and then vacuum stripping the heat soaked mixture at temperatures from 370°–420° C. The pitch comprises approximately 80 to 100% toluene insolubles by weight and is further characterized as being relatively free of impurities and ash.

It is an object of this invention to provide an improved pitch for manufacturing a carbon artifact.

It is another object of the invention to provide a pitch for manufacturing carbon fibers which is more uniform, and which is free of ash and impurities.

It is a further object of this invention to provide a pitch having high toluene insolubles, and which does not necessarily require Ti solvent extraction prior to spinning into fibers.

These and other objects of this invention will be better understood and will become more apparent with reference to the following detailed description considered in conjunction with the accompanying drawings.

BRIEF DESCRIPTION OF THE DRAWINGS A

FIGURE shows a graphical representation of various feedstocks including the deasphaltenated steam cracker tar bottom fraction of this invention, and corresponding Ti content materials derived from heat soaking these feed stocks.

DETAILED DESCRIPTION OF THE INVENTION

Generally speaking, the steam cracker tar which is used as a starting material in the process of the present invention is defined as the bottoms product obtained by cracking gas oils, particularly virgin gas oils, such as naphtha, at temperatures of from about 700° C. to about 1000° C. A typical process steam cracks gas oil and naphtha, at temperatures of 800° C. to 900° C., with 50% to 70% conversion to $C_3$ olefin and lighter hydrocarbons, by stripping at temperatures of about 200° C. to 250° C. for several seconds. The tar is obtained as a bottoms product. A gas oil is, of course, a liquid petroleum distillate with a viscosity and boiling range between kerosene and lubricating oil, and having a boiling range between about 200° C. and 400° C. Naphtha is a generic term for a refined, partly refined or unrefined liquid petroleum product of natural gas wherein not less than 10% distills below 175° C. and not less than 95% distills below 240° C., as determined by ASTM Method D-86. Steam cracker tars typically consist of alkyol substituted polycondensed aromatic compounds.

Obviously, the characteristics of a steam cracker tar vary according to the feed in the steam cracking plant.

Characteristics of typical steam cracker tars obtained from the steam cracking of naphtha, gas oil and desulfurized gas oil are respectively given in Table 1, below:

TABLE 1

Physical and Chemical Characteristics of Steam Cracker Tars from Naphtha, Gas Oil and Desulfurized Gas Oil Cracking

| | SCT from Naphtha Cracking | SCT from Gas Oil Cracking Ex (1) | SCT from Gas Oil Cracking Ex (2) | SCT from Desulfurized Gas Oil Cracking |
|---|---|---|---|---|
| 1. Physical Characteristics | | | | |
| Viscosity cst @ 210° F. | 13.9 | 19.3 | 12.4 | 25.0 |
| Coking Value at 550° F. (%) | 12 | 16 | 24 | 25 |
| Toluene Insolubles (%) | 0.200 | 0.200 | 0.250 | 0.100 |
| n-Heptane Insolubles (%) | 3.5 | 16 | 20 | 15 |
| Pour Point (°C.) | +5 | +5 | −6 | +6 |
| Ash (%) | 0.003 | 0.003 | 0.003 | 0.003 |
| 2. Chemical Structure (by carbon and proton NMR) | | | | |
| Aromatic Carbon (atom %) | 65 | 72 | 71 | 74 |
| Aromatic Protons (%) | 34 | 42 | 42 | 38 |
| Benzylic Protons (%) | 40 | 44 | 46 | 47 |
| Paraffinic Protons (%) | 25 | 14 | 12 | 15 |
| Carbon/Hydrogen Atomic Ratio | 0.942 | 1.011 | 1.079 | 1.144 |
| 3. Elemental Analysis | | | | |
| Carbon (wt %) | 91.60 | 90.31 | 88.10 | 90.61 |
| Hydrogen (wt %) | 8.10 | 7.57 | 6.80 | 6.60 |
| Nitrogen (wt %) | 0.15 | 0.10 | 0.15 | 0.18 |
| Oxygen (wt %) | 0.20 | 0.22 | 0.18 | 0.19 |
| Sulfur (wt %) | 0.06 | 1.5 | 4.0 | 1.5 |
| Iron (ppm) | 0.003 | 0.003 | — | — |
| Vanadium (ppm) | 0.000 | 0.001 | — | — |
| Silicon (ppm) | 0.001 | 0.00 | — | — |
| 4. Number Average Molecular Wt | 295 | 300 | 305 | 315 |
| 5. Distillation Characteristics | | | | |
| 5% Vol | 203 | 283 | 245 | — |
| 10% Vol | 233 | 296 | 260 | — |
| 20% Vol | 245 | 330 | 296 | — |
| 30% Vol | 266 | 373 | 358 | — |
| 40% Vol | 308 | 421 | 371 | — |
| 50% Vol | 356 | 470 | 401 | — |
| 60% Vol | — | 540 | — | — |
| 70% Vol | — | 601 | — | — |
| 77% Vol | — | 610 | — | — |

In the process of the present invention, the steam cracker tars are fractionally distilled by heating to elevated temperatures at reduced pressures. For example, the stream cracker tar is heated to temperatures in the range of 130° C. to 320° C. at an approximate pressure of 10 mm of mercury. Basically, the steam cracker tar is separated into a middle distillate fraction having a boiling point at 760 mm mercury in the range of from about 270° C. to about 490° C. In a particularly preferred embodiment of the present invention, the distillate fraction of the steam cracker tar which is employed in forming a suitable carbonaceous pitch for carbon artifact manufacture, is that fraction boiling in the range of about 370° to about 490° C. at 760 mm of mercury.

An ASTM D1160 distillation of a typical steam cracker tar is given in Table 2, below:

TABLE 2

| Vol % Distillate | Vapor Temperature @ 10 mmHg °G | Vapor Temperature @ 760 mmHg °G |
|---|---|---|
| 2 | 130 | 270 |
| 5 | 140 | 277 |
| 10 | 147 | 285 |
| 20 | 165 | 307 |
| 30 | 190 | 336 |
| 40 | 216 | 368 |
| 50 | 243 | 400 |
| 60 | 282 | 444 |
| 70 | 316 | 483 |
| 71 | 320 | 490 |

The middle fraction taken at distillate 370°–490° C. at 760 mmHg has high aromaticity and narrow molecular weight. It contains no ash or solid particulate and does not contain high coking asphaltene. Chemically it is composed of polycondensed 2, 3, 4 and 5 aromatic rings. Table 3 below gives the physical and chemical characteristics of a typical middle distillate fraction of steam cracker tar:

TABLE 3

| Characteristics of Steam Cracker Tar Distillate (370–490° C.) | |
|---|---|
| 1. Physical Characteristics | |
| Ash Content (%) | = Nil |
| Asphaltene (n-heptane insolubles) (%) | = Nil |
| Viscositty cps @ 99° C. | = 4.5 |
| Toluene Insolubles (%) | = Nil |
| Coking Value @ 550° C. (%) | = 2.0 |
| 2. Chemical Structure (CMR and PMR) | |
| Aromatic Carbon (atom %) | = 71 |
| Paraffinic Protons (%) | = 22 |

TABLE 3-continued

| Characteristics of Steam Cracker Tar Distillate (370–490° C.) | |
|---|---|
| Benzylic Protons (%) | = 41 |
| 3. Elemental Analysis | |
| Carbon (wt %) | = 90.7 |
| Hydrogen (wt %) | = 7.3 |
| Oxygen (wt %) | = 0.20 |
| Nitrogen (wt %) | = 0.10 |
| Sulfur (wt %) | = 1.6 |
| 4. Number Average Mol. Wt (GPC) | = 245 |
| 5. Aromatic Ring Distribution (MS) | |
| 1 Ring | = 3.7 |
| 2 Rings | = 43.6 |
| 3 Rings | = 39.2 |
| 4 Rings | = 11.1 |
| 5 Rings | = 1.5 |
| 6 Rings | = 0.8 |
| 7 Rings | = 0.1 |
| Aromatics with Carbon and Hydrogen | = 84.3 |
| Aromatics with Carbon, Hydrogen and Oxygen | = 3.7 |
| Aromatics with Carbon, Hydrogen and Sulfur | = 11.9 |
| 6. Average Carbon Atom in Side Chain | = 3.0 |

The molecular structure of a typical steam cracker tar middle distillate fraction as determined by high resolution Mass Spectrometer, is given below in Table 4:

TABLE 4

Molecular Structure of a Typical Steam Cracker Tar Distillate

| Compound Type | Typical Name | Wt % |
|---|---|---|
| $C_nH_{2n-8}$ | Indanes | 0.6 |
| $C_nH_{2n-10}$ | Indenes | 1.3 |
| $C_nH_{2n-12}$ | Naphthalenes | 5.0 |
| $C_nH_{2n-14}$ | Naphthenonaphthalene | 9.1 |
| $C_nH_{2n-16}$ | Acenaphthalenes | 17.2 |
| $C_nH_{2n-18}$ | Penanthrenes | 29.0 |
| $C_nH_{2n-20}$ | Naphthenophenanthrenes | 8.8 |
| $C_nH_{2n-22}$ | Pyrenes | 7.3 |
| $C_nH_{2n-24}$ | Chyrsenes | 2.3 |
| $C_nH_{2n-26}$ | Cholanthrenes | 0.9 |
| $C_nH_{2n-12}S$ | Naphthenobenzothiophenes | 0.4 |
| $C_nH_{2n-14}S$ | Indenothiophenes | 0.6 |
| $C_nH_{2n-16}S$ | Naphtnothiophenes | 8.5 |
| $C_nH_{2n-18}S$ | Naphthenonaphthothiophenes | 0.6 |
| $C_nH_{2n-20}S$ | | 0.5 |
| $C_nH_{2n-10}O$ | Benzofurans | |
| $C_nH_{2n-16}O$ | Naphthenofurans | 2.8 |
| $C_nH_{2n-18}O$ | Naphthenonaphthofurans | 0.44 |
| $C_nH_{2n-20}O$ | Acenaphthyenofurans | 0.2 |

Another method to prepare an asphaltene-free steam cracker tar fraction is by removing the asphaltene from steam cracker tar by a solvent extraction of the asphaltene with a paraffinic solvent such as n-heptane, isooctane, n-pentene, or pet-ether. Table 5, below, gives the characteristics of a deasphaltenated oil obtained from a steam cracker tar using n-heptane as a solvent (Feed:solvent ratio=1:30):

TABLE 5

The Preparation of Deasphaltenated Steam Cracker Tar

| | Steam Cracker Tar | | Deasphaltenated Steam Cracker Tar | |
|---|---|---|---|---|
| | 1 | 2 | 1 | 2 |
| Weight (%) | 100 | 100 | 80 | 82 |
| Sp. Gr. @ 15° C. | 1.112 | 1.117 | 1.084 | 1.073 |
| Coking Value @ 550° C. | 18.1 | 18.8 | 7.8 | 7.3 |
| Viscosity (cps) @ 100° F. | 779 | 925 | 33.0 | 22.2 |
| Ash Content (%) | 0.003 | 0.004 | Nil | Nil |
| Asphaltene (%) (n-heptane insolubles) | 20.0 | 18.0 | 1.0 | 1.2 |
| Carbon (%) | 87.2 | 86.6 | 86.7 | 87.22 |
| Hydrogen (%) | 6.7 | 6.6 | 6.91 | 7.22 |

TABLE 5-continued

The Preparation of Deasphaltenated Steam Cracker Tar

| | Steam Cracker Tar | | Deasphaltenated Steam Cracker Tar | |
|---|---|---|---|---|
| | 1 | 2 | 1 | 2 |
| Oxygen (%) | 0.32 | 0.31 | 0.46 | 0.21 |
| Sulfur (%) | 3.7 | 5.3 | 4.5 | 4.5 |
| Aromatic Carbon (atom %) | 73 | 72 | 70 | 71 |
| C/H Atomic Ratio | 1.07 | 1.10 | 1.04 | 1.00 |

After separating the steam cracker tar middle fraction distillate, the middle fraction distillate is heat soaked at temperatures in the range of about 400° C. to 500° C. Optionally and preferably, the heat soaking is conducted at temperatures in the range of about 390° C. to about 450° C., and most preferably at temperatures in the range of about 410° C. to about 440° C. In general, heat soaking is conducted for times ranging from one minute to about twenty hours, and preferably from about two to six hours. In the practice of the present invention, it is particularly preferred that heat soaking be done in an atmosphere such as nitrogen, or alternatively in hydrogen atmosphere. Heat soaking also may be conducted at reduced pressures in the range of from about 50 to 100 mm of mercury.

After heat soaking the distillate, the heat soaked distillate is then heated in a vacuum at temperatures generally about 400° C. and typically in the range of about 370° C. to 420° C., at pressures below atmospheric pressure, generally in the range of about 1.0 to 100 mm mercury. This additional heating removes at least part of the oil present in the heat soaked distillate. Typically, from about 90 to 100% of the oil which is present in the heat soaked distillate is removed.

As can be readily appreciated, the severity of the heat soaking conditions outlined above, will affect the nature of the pitch produced. The higher the temperature chosen for heat soaking, and the longer the duration of the heat soaking process, the greater the amount of toluene insoluble components that will be generated in the pitch.

Aromatic pitch can be characterized by various instrumental techniques. The aromaticity of pitch prepared from steam cracker tar distillate is very high, around 87% (measured by carbon NMR). These pitches have high C/H atomic ratio and contain little or no oil.

Solvent analysis is widely used to define or characterize the pitch composition and/or the liquid crystal fraction in the pitch. We define the pitch of this invention by the toluene insolubles content (by weight percent). The quinoline insolubles in the pitch is also a useful guide in defining the pitch characteristics.

The inventive process can prepare pitches with a very high toluene insolubles content (80–100% by weight) and low quinoline insolubles content (0.1–15% by weight). This pitch content can only be produced because of the use of a middle distillate fraction which has a low molecular weight and contains 2, 3, 4 and 5 polycondensed aromatic rings.

As is disclosed in U.S. Pat. No. 4,208,267, in carbon fiber manufacture, it is particularly beneficial to use a fraction of the pitch which is readily convertible into a deformable optically anisotropic phase. Consequently, in the process of the present invention, it is particularly preferred to isolate that fraction of the heat soaked and vacuum stripped steam cracker distillate which is readily convertible into a deformable optically anisotropic phase. The preferred technique for isolating that fraction of the pitch is set forth in U.S. Pat. No. 4,208,267, which patent is incorporated herein by reference. Basically, that process requires treatment of the pitch with the solvent system which consists of a solvent or mixture of solvents that has a solubility parameter of between 8.0 and 9.5 and preferably between 8.7 and 9.2 at 25° C.

Also and more preferably when extracting a fraction of a completely de-oiled pitch prepared from steam cracker tar distillate, it is preferred to use a single solvent, such as toluene. The crushed or molten pitch is mixed with toluene at 1:2 to 1:16 pitch/toluene ratio, and the mixture is agitated for 3–20 hours at room temperature. The toluene insoluble fraction is then filtered, washed and dried.

The toluene insolubles in the pitch can also be determined by a one stage extraction method, by simply agitating the pitch and toluene (pitch:toluene ratio = 1:8) at room temperature for 4 hours and then filtering, washing and drying the extract.

The optical anisotropicity of the pitch was determined by first heating the pitch to 375° C. and then cooling the pitch. A sample of the pitch was then placed on a slide with Permount, a histological mounting medium sold by the Fisher Scientific Company, Fairlawn, New Jersey. A slip cover was placed over the slide by rotating the cover under had pressure. The mounted sample was crushed to a powder and evenly dispersed on the slide. Thereafter, the crushed sample was viewed under polarized light at a magnification of 200×, and the percent optical anisotropicity was estimated.

TABLE 6

| | Preparation of Steam Cracker Tar Distillate Pitch | | | | | | | | | | | |
|---|---|---|---|---|---|---|---|---|---|---|---|---|
| | | | | | | Pitch Composition | | | Toluene Insoluble (SEP) Characteristics | | | |
| | Heat Soaking | | Vacuum Stripping | | | | | | | | | |
| Example | Temperature (°C.) | Time (hrs) | Pressure (mmHg) | Liquid Temperature (°C.) | % Oil Removed | Toluene Insolubles (SEP) (%) | Quinoline Insolubles (%) | Toluene Insolubles (One-Stage Method) (%) | Tg[1] | C/H | Viscosity cps @ 360° C. | (%) Optical Activity |
| 1 | 420 | 4 | 1.0 | 370 | 11.2 | 50.4 | 1.9 | | 256 | 1.86 | — | — |
| 2 | 430 | 3 | 1.0 | 370 | 14.8 | 54.0 | 1.3 | | 255 | 1.80 | — | — |
| 3 | 430 | 4 | 0.2 | 360 | 12.3 | 80.0 | 8.0 | 95 | 249 | 1.83 | 1,393 | 75+ |
| 4 | 430 | 4 | 0.5 | 400 | 10.3 | 86.0 | 0.4 | 100 | 249 | 1.80 | 1,210 | — |

[1]Tg = Glass Transition Temperature

EXAMPLES 1–4

The following experimental method was used:

About 600 grams of a steam cracker tar middle distillate fraction was charged to an electrically heated reactor equipped with nitrogen injection and mechanical agitation. The feed is then heated to the desired temperature, 420°–440° C., under a blanket of nitrogen and allowed to react at that temperature for the desired time, 15 to 90 minutes, with good agitation under nitrogen.

The heat soaked mixture was then vacuum stripped at reduced pressure, 0.2–1.0 mmHg, at a liquid temperature of 400°–420° C. to remove most, if not all, of the distillable oils. The vacuum stripped pitch is allowed to cool under reduced pressure and discharged. Results for these Examples 1–4, are listed in Table 6.

The percent quinoline insolubles in the product pitch was deterined by the standard technique of quinoline extraction at 75° C. (ASTM Test Method D2318/76).

The toluene insoluble fraction of the pitch was determined by the following method:

About 40 grams of the crushed pitch product were mixed for 18 hours at room temperature with 320 ml of toluene. The mixture was thereafter filtered using a 10–15 micron fritted glass filter.

The filter cake was washed with 80 ml of toluene, reslurried and mixed for about four hours at room temperature with 120 ml of toluene, and then filtered using a 10–15 micron glass filter.

The filter cake was washed with 80 ml of toluene followed by a wash with 80 ml of heptane, and finally the solid was dried at 120° C. in a vacuum for 24 hours.

The above method for determining toluene insolubles is hereinafter referred to as the SEP method (an achronym for the standard extraction procedure).

Referring to the illustrative FIGURE, various feedstocks are shown including the deasphaltenated steam cracker tar bottom fraction of this invention. These feedstocks are shown divided into their corresponding percentages of useable (precursor) pitch materials, and non-useable (non-precursor) pitch materials. It is observed that when all the cat cracker bottom fractions are used to obtain precursor materials, only a small percentage of liquid crystal rich materials are obtained. For example, heat soaked Ashland Pitch is observed to contain only approximately 25 percent Ti precursor.

Such a pitch material must be further treated to extract the useable Ti fraction. However, the problem with extracting the Ti content from such a pitch material is that it is very difficult to do this without also including the so-called "bad actors". In other words, the impurities and ash are also carried along. In addition, heat treating these low Ti materials will very often produce coke, which is detrimental to the spinning process.

Therefore, the elimination of the "bad actors" and the coke producing substances in advance of further processing would not only be desirable in producing a trouble-free precursor material, but also should usually eliminate the need to perform an additional extraction step.

Thus, it is observed that a feedstock material which uses only a middle fraction, i.e. distillate fractions (370°–490° C.), of a steam cracker tar bottom, will be virtually free of the "bad actors", and will contain between 80 and 100% Ti after heat soaking and vacuum stripping. Such precursor materials will be very uniform, relatively free of ash and impurities as further defined by a low quinoline insoluble content (less than 15% by weight), and will easily lend themselves to further controlled processing.

As aforementioned, such precursors may not require an additional extraction step for the Ti.

The FIGURE also represents similar results obtained from other feedstock materials such as Steam Cracker Tars (SCT) and Cat Cracker Bottoms (CCB). When the middle fractions of these feedstocks are separated, heat soaked, and vacuum stripped, it is observed that high content Ti substances are also produced.

Thus, the invention is not necessarily limited to the starting materials, but rather to the realization of the need to prefractionate and separate the middle fractions from these materials, and to vacuum strip these fractions after heat soaking at temperatures generally in excess of 400° C.

A pitch of this invention can be generally defined by the following solvent analysis:

| Solvent Analysis | |
|---|---|
| Toluene insolubles wt % (SEP method) | 80–100 |
| Quinoline insolubles wt % (ASTM D2318-66) | 1.0–15 (preferably less than 5%) |
| Aromaticity (% Aromatic carbon atom) | 80–90 |
| Melting point (°C.) | 150–250 |
| Glass Transition Temperature (°C.) (Tg) | 170–220 |
| Ash wt % | nil–0.1 |
| Optical Activity (% by polarized light microscopy) | 70–100 |

Having thus described this invention, what is desired to be protected by Letters Patent is presented in the following appended claims.

What is claimed is:

1. A pitch suitable for carbon artifact manufacture, comprising by weight content between 80 and 100 percent toluene insolubles, said pitch having been derived, by heat soaking followed by vacuum stripping, from a deasphaltenated middle fraction of a steam cracker tar feedstock which is rich in 2, 3, 4 and 5 polycondensed aromatic rings, and wherein said pitch is further characterized as being relatively free of impurities and ash.

2. The pitch of claim 1, wherein said middle fraction is a distillate fraction boiling off at temperatures approximately between 370° and 490° C. at 760 mm of mercury.

3. A pitch suitable for carbon artifact manufacture, such as the manufacture of carbon fibers, comprising by weight content between 80 and 100 percent toluene insolubles, and derived, by heat soaking followed by vacuum stripping, from a deasphaltenated middle fraction of a steam cracker tar bottom, said middle fraction being a distillate fraction boiling off at a temperature approximately between 370° and 490° C. at 760 mm mercury, said pitch being further characterized as being relatively free of impurities and ash.

4. The pitch of claim 3, wherein said middle fraction is rich in 2, 3, 4, and 5 polycondensed aromatic rings.

5. A pitch suitable for carbon artifact manufacture, comprising by weight content between 80 and 100 percent toluene insolubles, said pitch having been derived, by heat soaking followed by vacuum stripping, from a deasphaltenated middle fraction of a steam cracker tar feedstock which is rich in 2, 3, 4, and 5 polycondensed aromatic rings, and wherein said pitch is further characterized as having approximately less than 15 percent quinoline insolubles by weight.

6. The pitch of claim 5, wherein said middle fraction is a distillate fraction boiling off at temperatures approximately between 370° and 490° C. at 760 mm of mercury.

7. A process for preparing a pitch suitable for carbon artifact manufacture, comprising the steps of:

(a) obtaining a deasphaltenated middle fraction of a steam cracker tar feedstock which is rich in 2, 3, 4 and 5 polycondensed aromatic rings;

(b) subjecting said middle fraction to heat soaking to produce a pitch intermediate; and (c) stripping oils from said pitch intermediate to produce a pitch comprising between 80 and 100 percent by weight of toluene insolubles, and which is further characterized as being relatively free of impurities and ash.

8. The process of claim 7, wherein said heat soaking of said middle fraction is accomplished at a temperature in an approximate range of between 390° and 450° C. for a duration of from 1 minute to 20 hours at 760 mm of mercury.

9. The process of claim 8, wherein said middle fraction is heat soaked at approximately 430° C. for 2 to 6 hours at 760 mm of mercury.

10. The process of claim 7, wherein said middle fraction is obtained by distilling said feedstock at a temperature in an approximate range of between 370° and 490° C. at 760mm of mercury.

11. The process of claim 10 wherein said oils are removed by vacuum stripping said intermediate at a temperature in an approximate range of between 370° to 420° C. at approximately 1 to 100 mm of mercury.

12. A process for preparing a pitch suitable for carbon artifact manufacture, comprising the steps of:

(a) distilling a steam cracker tar feedstock to obtain a deasphaltenated middle fraction rich in 2, 3, 4, and 5 polycondensed aromatic rings;

(b) heat soaking said middle fraction; and (c) vacuum stripping said heat soaked middle fraction to remove oils therefrom, resulting in a pitch comprising 80 to 100 percent by weight of toluene insolubles and further characterized as being relatively free of impurities and ash.

13. The process of claim 12, wherein said heat soaking step (b) includes heat soaking said middle fraction at a temperature in an approximate range of between 390° and 450° C. for a duration of from 1 minute to 20 hours at 760 mm of mercury.

14. The process of claim 13, wherein said middle fraction is heat soaked at approximately 430° C. for 2 to 6 hours at 760 mm of mercury.

15. The process of claim 12, wherein said distilling step (a) includes distilling said feedstock at a temperature in an approximate range of 370° to 490° C. at 760 mm of mercury.

16. The process of claim 12, wherein said vacuum stripping step (c) includes vacuum stripping said heat soaked middle fraction at a temperature in an approximate range of between 370° and 420° C. at approximately 1 to 100 mm of mercury.

17. A process for preparing a pitch suitable for carbon artifact manufacture, comprising the steps of:

(a) distilling a steam cracker tar bottom to obtain a deasphaltenated middle fraction rich in 2, 3, 4, and 5 polycondensed aromatic rings;

(b) heat soaking said middle fraction; and (c) vacuum stripping said heat soaked middle fraction to remove oils therefrom, resulting in a pitch comprising 80 to 100 percent by weight of toluene insolubles and further characterized as being relatively free of impurities and ash.

18. A pitch suitable for carbon artifact manufacture made by the process including the steps of:

(a) distilling a steam cracker tar to obtain a deasphaltenated middle fraction rich in 2, 3, 4, and 5 polycondensed aromatic rings;

(b) heat soaking said middle fraction; and (c) vacuum stripping said heat soaked middle fraction to remove oils therefrom, resulting in a pitch comprising 80 to 100 percent by weight of toluene insolubles and further characterized as being relatively free of impurities and ash.

19. A process for preparing a pitch suitable for carbon artifact manufacture, comprising the steps of:

(a) distilling a steam cracker tar bottom to obtain a deasphaltenated middle fraction rich in 2, 3, 4, and 5 polycondensed aromatic rings;

(b) heat soaking said middle fraction; and (c) vacuum stripping said heat soaked middle fraction to remove oils therefrom, resulting in a pitch comprising 80 to 100 percent by weight of toluene insolubles and further characterized as having approximately less than 15% by weight quinoline insolubles.

20. A pitch suitable for carbon artifact manufacture made by the process including the steps of:

(a) distilling a steam cracker tar to obtain a deasphaltenated middle fraction rich in 2, 3, 4, and 5 polycondensed aromatic rings; p1 (b) heat soaking said middle fraction; and (c) vacuum stripping said heat soaked middle fraction to remove oils therefrom, resulting in a pitch comprising 80 to 100 percent by weight of toluene insolubles and further characterized as having approximately less than 15% by weight quinoline insolubles.

* * * * *